United States Patent [19]

Shreve

[11] Patent Number: 4,909,409

[45] Date of Patent: Mar. 20, 1990

[54] QUICK CHANGE SPRAY PAINT RECEPTACLE APPARATUS

[76] Inventor: Donald R. Shreve, 2712 Feasler St., Erie, Pa. 16506

[21] Appl. No.: 306,069

[22] Filed: Feb. 6, 1989

Related U.S. Application Data

[63] Continuation-in-part of Ser. No. 123,765, Nov. 23, 1987, Pat. No. 4,824,018.

[51] Int. Cl.[4] ..... B05B 1/00; B65D 47/00

[52] U.S. Cl. ..... 220/374; 220/90; 239/318; 239/347; 222/464; 222/630

[58] Field of Search ..... 220/90, 212, 300, 306, 220/367, 373, 374; 222/95, 181, 464, 630, 632; 239/318, 346, 347

[56] References Cited

U.S. PATENT DOCUMENTS

| | | | |
|---|---|---|---|
| 2,622,770 | 12/1952 | Penno | 222/464 |
| 3,088,679 | 5/1963 | Ford | 239/347 |
| 3,198,438 | 8/1965 | Hultgren | 239/318 |
| 3,240,398 | 3/1966 | Dalton | 222/630 |
| 3,401,842 | 9/1968 | Morrison | 222/181 |
| 3,642,167 | 2/1972 | Kinney | 220/60 R |
| 3,805,994 | 4/1974 | Cherry et al. | 220/60 R |
| 3,940,069 | 2/1976 | Gunzel, Jr. et al. | 239/318 |
| 4,147,278 | 4/1979 | Uhlig | 222/95 |
| 4,151,929 | 5/1979 | Sapien | 220/404 |
| 4,307,820 | 12/1981 | Binoche | 220/374 |
| 4,824,018 | 4/1989 | Shreve | 220/90 |

FOREIGN PATENT DOCUMENTS

| | | | |
|---|---|---|---|
| 0159385 | 6/1957 | Sweden | 220/373 |

*Primary Examiner*—Jimmy G. Foster
*Attorney, Agent, or Firm*—Charles L. Lovercheck; Wayne L. Lovercheck; Dale R. Lovercheck

[57] ABSTRACT

A lid for a paint can is disclosed which has a wiper for removing paint from a paint tube and a vent assembly to allow air to enter the can and resists the escape of paint. The wiper removes the excess paint from the paint tube and allows the paint gun and tube to be readily removed from the can and prevents loss of paint through the vent opening.

11 Claims, 2 Drawing Sheets

QUICK CHANGE SPRAY PAINT RECEPTACLE APPARATUS

REFERENCE TO PRIOR APPLICATION

This application is a Continuation-In-Part of U.S. patent application Ser. No. 123,765, filed Nov. 23, 1987. now U.S. Pat. No. 4,824,018.

BACKGROUND OF THE INVENTION

The invention relates to paint spraying apparatus and more particularly to paid receptacles in which individual paint colors can be stored and readily used.

GENERAL DESCRIPTION OF THE INVENTION

The paint receptacle apparatus disclosed herein is made up of four pieces: (1) the receptacle, (2) the lid, (3) the wiper and (4) a plug. The receptacle is for holding the liquid and has a flange around the outer perimeter which cooperates with the flange and provides a seal. An assembly or a vent hole is provided in the lid to allow air to replace the liquid as it is used. A fluid tube hole is provided for the spray gun interface to enter. The fluid tube hole provides a means for inserting the tube and removing the liquid. The wiper at the fluid tube hole removes the liquid on the outside of the tube during withdrawal of the tube from the lid. A plug, or plugs, is provided to close the fluid tube hole and the vent hole in the lid when the assembly is not in use. As an alternate, the two holes can be combined in a single vent assembly as in FIG. 5. The gun can be moved from one can to another.

Plastic is defined herein as impressionable; easily influenced; flexible while elastic means having the property of immediately returning to its original size, shape or position after being stretched, squeezed, flexed, expanded, etc.

At present the elastic materials available cannot satisfactorily meet solvent requirements. The best elastics absorb solvents and swell. By using design factors available in plastic materials and limiting the ability to exceed their functional limits, it is possible to provide a practical wiper along with the other features on the cup and lid. The property of the plastics can be enhanced in many ways like molded molecular alignment, post molding grain structuring, blending with other plastic, and with elastic materials within acceptable limitations.

GENERAL STATEMENT OF THE INVENTION

The paint receptacle apparatus disclosed herein can be made to fit spray guns manufactured by a variety of spray paint equipment manufacturers. The paint receptacle apparatus can be hand held, keeping it simple and easy for cleaning. The paint receptacle could be suspended from a spray gun or even the fluid tube by attaching it to a bracket. The paint receptacle could be provided with a fluid tube simpler than now available and different types of tubes could be provided to fit each particular gun manufacturers' equipment. The lid can be provided with baffles to prevent the liquid in the receptacle from splashing out of the vent holes. In addition, this will make cleanup less difficult. The improved features of the paint receptacle apparatus disclosed herein are: (1) The lid is separate and easily removable from the receptacle. The lid is removably mounted to the fluid tube of the spray gun; (2) the receptacle may be one of a full line of receptacles for colors and sizes; (3) the lid may have the vent hole and wiper for wiping the fluid tube; (4) the lid may be provided with a release feature to compensate for the force required to seal the lid; (5) the receptacle and lid assembly may be hung from the fluid tube.

The present paint receptacle apparatus can be applied to lacquer, primers, various colors for small jobs for different colors of automobiles or the like. Gun cleaning solvent to flush clean inside the tube and spray gun between uses can be used. The apparatus disclosed can be used for flexible paints, for rubber paints, primers, color coats, and clear coats, these parts are sometimes painted separately from the rest of an automobile generally.

REFERENCE TO PRIOR ART

Previous attempts at solving the problem solved by the invention herein have been made by provided a plastic liner for use with the existing cup on the gun. Example of such a liner are shown in U.S. Pat. Nos. 2,622,770 to Penno, 3,401,842 to Morrison, 4,151,929 to Sapien and 4,307,820 to Binoche. The liner was meant to be disposable, keeping the cup clean. To make the liner work, the liner has to be held in position while the paint or liquid is put in it. This required a two-piece holding ring, one at the inside of the liner. The other ring would be used to turn the excess material of the bag down out of the way for filling. The problem with this method is that it leaves the majority of the hard cleaning of excess paint still to be done. Another problem is the time consuming and not time saving. Finally it provides no storing ability for mixed, ready-to-use paints or liquids.

Another problem exists in fitting covers or lids to paint cans. Examples are found in U.S. Pat. Nos. 3,642,167 to Kinney and 3,085,994 to Cherry et al.

A specific can lid is disclosed which is an improvement over the above U.S. Patents.

OBJECTS OF THE INVENTION

It is an object of the invention to provide an improved paint receptacle lid apparatus.

Another object of the invention is to provide a spray painting apparatus for various kinds of paint ready to use.

Another object of the invention is to provide a spray painting apparatus that is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

DETAILED DESCRIPTION OF THE DRAWINGS

Figure 1:
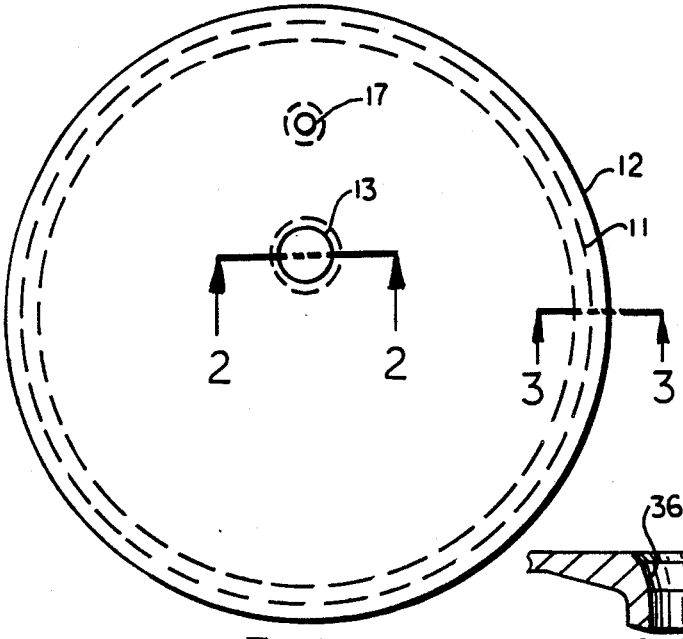
FIG. 1 is a top view of the paint can lid and wiper according to the invention.
Figure 2:
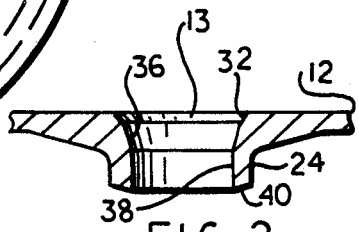
FIG. 2 is a partial cross sectional view of the apparatus shown in FIG. 1, taken on line 2—2 of FIG. 1.

Now with more particular reference to the drawings, I show a paint can lid 12 of the type shown in the parent application. Lid 12, in the form of a generally found disk-like body, has vent hole 17 and fluid tube opening 13. Lid 12 has attaching means 11, which may support lid 12 on a paint can of the type shown in the parent application. Lid 12 is intended to be used with a can which has a downwardly extending edge flange.

Fluid tube opening 13 has a wiper which includes chamfer 32, which aids in starting a fluid tube into opening 13. A sealing means is provided made up of tapered countersunk part 36 which may extend inwardly relative to generally cylindrical surface 38 at an angle of approximately 15 degrees. In practice, generally cylindrical surface 38 could taper outwardly and downwardly at an angle of 5 degrees. Flange 24 is integral with lid 12, extends downward and terminates at its lower end in tapered end surface 40. Tapered end surface 40 may be tapered at, for example, outwardly and upwardly at about 16 degrees.

Figure 2A:
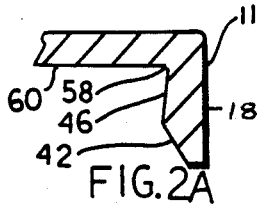
FIG. 2A is a partial cross sectional view taken on line 3—3 of FIG. 1.

Referring to FIG. 2A, surface 42 at the lower end of rim 18 may taper inwardly and upwardly at an angle of approximately 30 degrees. Surface 46 adjacent inner surface 60 of lid 12 tapers upwardly and outwardly at about 10 degrees. Radius 58 may be formed by joining surface 46 and inner surface 60 on a radius of 0.020 inches.

Figure 3:
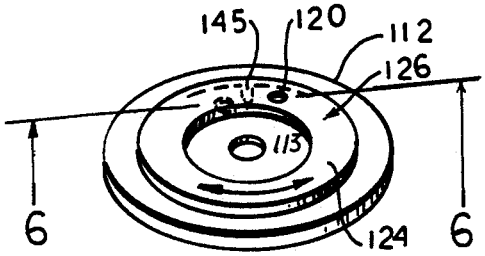
FIG. 3 is an isometric view of another embodiment of the invention.
Figure 6:
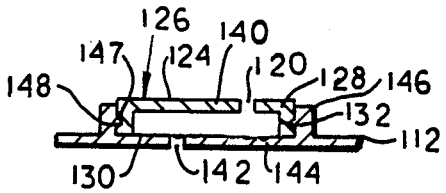
FIG. 6 is a partial cross sectional view taken on line 6—6 of FIG. 3.

Now with regard to the embodiment of the invention shown in FIGS. 3 and 6, lid 112 has fluid tube opening 113 and vent assembly 126. Vent assembly 126 is circular, providing annular cavity 130. Cavity 130 has outside vent 120 and inside vent 142, which are out of alignment with each other to prevent splashing of paint that may accumulate in cavity 130. Vent assembly 126 includes annular removable top 124. Top 124 can be removed for cleaning dried paint from cavity 130. Top 124 has two spaced downwardly extending annular flanges 128. Flanges 128 have external groove 132.

Lid 112 has integral upwardly extending annular flanges 146 and 147 which have inwardly extending beads 148. Beads 148 snap into groove 132 holding top 124 in place.

Outer wall 140 is held in spaced relation to inner wall 144 by means of divider 145. Divider 145 also prevents air and paint from going directly from inside vent 142 to outside vent 120. The path paint must follow is from inside vent 142 around an annular path inside top 124 to outside vent 120. Divider 145 forms a partition and prevents significant flow of paint in the short distance between outer wall 140 and lid 112. Cavity 130, between outer wall 140 and inner wall 144, prevents significant flow of paint in cavity 130. Cavity 130 is disposed above the top surface of lid 112, leaving the inside of lid 112 unobstructed.

Figure 4:
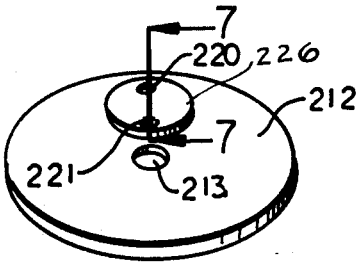
FIG. 4 is an isometric view of another embodiment of the lid.
Figure 7:
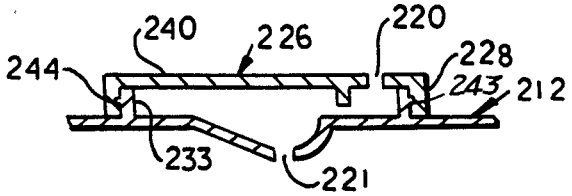
FIG. 7 is a partial elarged cross sectional view taken on line 7—7 of FIG. 4.

Now with regard to the embodiment of FIGS. 4 and 7, lid 212 has fluid tube opening 213. Lid 212 has vent assembly 226, which has outside vent 220 and inside vent 221. Fluid tube opening 213 may have one of the sealing means as shown in FIGS. 8 through 12. Top 240 has downwardly extending circular rim 228 which receives upwardly extending rim 233 and lid 212. Bead 244 on rim 233 snaps into internal groove 243 in rim 228 and holds the cover of vent assembly 226 in place.

Figure 5:
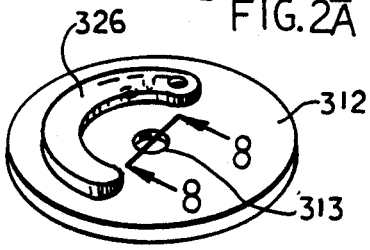
FIG. 5 is an isometric view of yet another embodiment of the lid.
Figure 8:
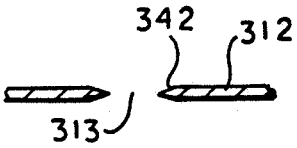
FIG. 8 is a partial enlarged cross sectional view, taken on line 8—8 of FIG. 5.

Now with regard to the embodiment of the invention in FIGS. 5 and 8, lid 312 has vent assembly 326. Fluid tube opening 313 in lid 312 is bounded by marginal edge 342 which is wedge shaped and terminates in a sharp edge. Edge 342 forms a seal and wipes paint from the fluid tube of a paint gun when it is withdrawn from lid 312.

Figure 9:
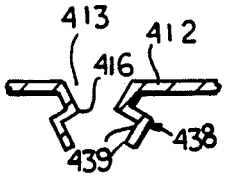
FIG. 9 is a partial enlarged cross sectional view similar to FIG. 8, of another embodiment of the invention.

With regard to the embodiment shown in FIG. 9, lid 412, similar to lid 12 shown in FIG. 1, has fluid tube opening 413 that has downwardly and inwardly extending peripheral convoluted integral flange 438. In practice, a fluid tube, such as the tube from a paint gun, will be inserted into opening 413 and two annular edges 416 and 439 will wipe paint from the paint tube.

Figure 10:
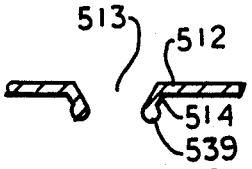
FIG. 10 is a partial enlarged cross sectional view similar to FIG. 8, of another embodiment of the invention.

Now with reference to the embodiment of the invention shown in FIG. 10, lid 512 is shown having a fluid tube opening 513. Downwardly and inwardly extending flange 514 may be integrally attached to the lower side of lid 512. Flange 514 has annular tube engaging cylindrical bead 539 which engages a fluid tube for wiping paint from the tube.

Figure 11:
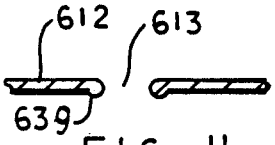
FIG. 11 is a partial enlarged cross sectional view similar to FIG. 8 of another embodiment of the invention.

Now with regard to the embodiment of the invention shown in FIG. 11, lid 612 has fluid tube opening 613 with peripheral bead 639, which is generally cylindrical in cross section and performs a wiping action on a fluid tube.

Figure 12:
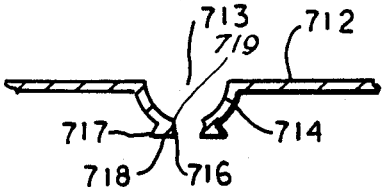
FIG. 12 is a partial enlarged cross sectional view, similar to FIG. 8, of another embodiment of the invention.

Now with reference to FIG. 12, lid 712 has fluid tube opening 713 which has downwardly extending concave flange 714 which terminates in an enlarged part with inwardly extending edge 716, outwardly extending edge 717 and flat end surface 718. Edges 716 and 719 engage a paint tube and wipe paint from the paint tube when the paint tube is being withdrawn from lid 712.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property of privilege is claimed are defined as follows:

1. A lid for a paint can in the form of a generally round disk-like body, said lid having a vent assembly therein, a fluid tube opening in said lid, said fluid tube opening having sealing means, said lid having attaching means on an outer peripheral edge for attaching said lid to a paint can. a downwardly extending flange integral with said lid and surrounding said fluid tube opening, said fluid tube opening being defined by a tapered generally conical surface on said flange adjacent a first side of said lid and a generally cylindrical surface adjacent an inner end of said tapered conical surface forming the inner surface of said fluid tube opening, said generally conical tapered surface tapering inwardly away from said lid at an angle of about 15 degrees to the central axis of said generally cylindrical surface, said generally cylindrical surface joining said tapered generally conical surface and tapering away from said lid and inwardly at a relatively small angle.

2. The lid recited in claim 1 wherein said fluid tube opening is chamfered at its end adjacent said first side of said lid.

3. The lid recited in claim 2 in said outer wall is attached to said flange and forms a closure over the top of said cavity.

4. The lid recited in claim 3 wherein said vent assembly comprises a part of a cup like member having a partially cylindrical downwardly extending flange attached thereto, a bead on an upwardly extending flange and a groove in said downwardly extending flange, said groove receiving said bead and removably holding said outer wall in position on said upwardly extending flange.

5. The lid recited in claim 2 wherein said sealing means on said lid includes a relatively sharp tube-engaging edge surrounding said fluid tube opening and adapted to form sealing engagement with said paint tube.

6. The lid recited in claim 2 wherein said sealing means comprises a downwardly extending flange defining a concave area terminating at its lower end in an enlarged flange having a relatively flat bottom and two spaced inwardly extending relatively thin annular edges adapted to engage a fluid tube.

7. The lid recited in claim 1 wherein said tapered generally conical surface extends downwardly and terminates in an annular bead, said bead being round in cross section and adapted to engage a paint tube.

8. A lid for a paint receptacle adapted to have a removable spray gun having a paint tube supported thereon and an integral wiper to wipe paint from said paint tube, attaching means for supporting said lid on said paint receptacle, said lid having a fluid tube opening, said fluid tube opening having sealing means for engaging a paint tube, a vent assembly, said vent assembly comprising an outer wall and an inner wall of resilient, flexible material, an annular flange between said outer wall and said inner wall fixed to and holding said inner wall and said outer wall in spaced relation to one another and defining a cavity between, an inside vent through said inner wall and an outside vent through said outer wall, said inside vent being offset from said outside vent whereby paint in said cavity will be retained.

9. The lid recited in claim 8 wherein said outer wall is removably supported on said flange.

10. The lid recited in claim 8 wherein a divider is attached to said outer wall between said inside vent and said outside vent, said divider extends downwardly and terminates in spaced relation to said inner wall restricting the passage of paint from said inside vent to said outside vent.

11. The lid recited in claim 8 wherein a divider is attached to said outer wall and extends toward and is attached to said inner wall closing a path directly from said inside vent to said outside vent whereby air and paint flow around said path from said inside vent to said outside vent.

* * * * *